US009238369B2

(12) United States Patent
Misumi

(10) Patent No.: US 9,238,369 B2
(45) Date of Patent: Jan. 19, 2016

(54) METHOD FOR INJECTING LIQUID INTO LIQUID STORAGE CONTAINER

(71) Applicant: CANON KABUSHIKI KAISHA, Tokyo (JP)

(72) Inventor: Yoshinori Misumi, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/572,494

(22) Filed: Dec. 16, 2014

(65) Prior Publication Data

US 2015/0202880 A1 Jul. 23, 2015

(30) Foreign Application Priority Data

Jan. 17, 2014 (JP) ..... 2014-006788
Oct. 24, 2014 (JP) ..... 2014-217485

(51) Int. Cl.
*B41J 2/175* (2006.01)

(52) U.S. Cl.
CPC ..... *B41J 2/17506* (2013.01)

(58) Field of Classification Search
USPC ..... 347/7, 84–86
See application file for complete search history.

(56) References Cited

U.S. PATENT DOCUMENTS

2011/0211028 A1* 9/2011 Tsukamoto et al. ..... 347/86

FOREIGN PATENT DOCUMENTS

JP 2006-159656 6/2006
JP 2006-224433 8/2006

* cited by examiner

*Primary Examiner* — Lam Nguyen
(74) *Attorney, Agent, or Firm* — Fitzpatrick, Cella, Harper & Scinto

(57) ABSTRACT

A meeting surface between inks injected from the injection needles can be made closer to the filter by varying the timings of the ink injections from the plurality of injection needles, whereby larger pressure is applied to the filter. When pressure is applied which is larger than the ink holding force of the filter generated from the surface tension of the inks, the inks pass through the filter to fill space from an ink supply path to an ink path in a print head. In this manner, ink pressure on the filter can be appropriately controlled without increasing the amount of the ink from the injection needle above the filter. As a result, the inks pass through the filter to fill the ink path in the print head, and the inks can be prevented from leaking from ejection openings at the time of filling the inks.

13 Claims, 7 Drawing Sheets

METHOD FOR INJECTING LIQUID INTO LIQUID STORAGE CONTAINER

BACKGROUND OF THE INVENTION

1. Field of the Invention

The present invention relates to a method for injecting a liquid into a liquid storage container, and particularly relates to a method for injecting a liquid into a liquid storage container for storing a liquid to be supplied to a liquid ejection head for ejecting a liquid such as an ink.

2. Description of the Related Art

As a method for injecting a liquid into a liquid storage container, Japanese Patent Laid-Open No. 2006-159656 describes a method for injecting inks by inserting a plurality of injection needles into a holding member for holding an ink in an ink tank. According to this method, inks can be injected into the ink holding member uniformly.

Further, Japanese Patent Laid-Open No. 2006-224433 describes appropriately controlling ink injection pressure on a filter provided in an ink path between an ink tank and a print head when filling an ink. This can prevent an ink leak through ejection openings of the print head at the time of filling or refilling an ink.

SUMMARY OF THE INVENTION

In a first aspect of the present invention, there is provided a method for injecting a liquid into a liquid holding member in a liquid storage container, in a liquid ejection system having the liquid storage container containing therein the liquid holding member for holding a liquid and a liquid ejection head which is in liquid communication with the liquid storage container via a filter, the method comprising: a step of inserting a plurality of injection needles into the liquid holding member, at least one of the injection needles being inserted above the filter; and a step of injecting liquids from the plurality of injection needles into the liquid holding member so that a meeting surface between a liquid injected from the injection needle above the filter and a liquid injected from an injection needle adjacent to the injection needle above the filter is located closer to the injection needle above the filter than the injection needle adjacent to the injection needle above the filter.

Further features of the present invention will become apparent from the following description of exemplary embodiments (with reference to the attached drawings).

DESCRIPTION OF THE EMBODIMENTS

As described in Japanese Patent Laid-Open No. 2006-224433, appropriately controlling liquid pressure on a filter provided in a liquid path between a liquid storage container and a liquid ejection head when filling the storage container with a liquid is effective in appropriately filling the liquid without a liquid leak at the time of filling or the like. However, the feature described in Japanese Patent Laid-Open No. 2006-224433 is to control the liquid pressure on the filter by supplying gas from the side of the ejection openings of the print head, and has a problem that a configuration for the above control becomes complicated.

On the other hand, the method for injecting liquids by using a plurality of injection needles as described in Japanese Patent Laid-Open No. 2006-159656 makes it possible to fill liquids with a relatively simple configuration.

An object of the present invention is to provide a method for injecting liquids into a liquid storage container by using a plurality of injection needles, which method makes it possible to appropriately control, with a simple configuration, liquid pressure on a filter provided in a liquid path.

Embodiments of the present invention will be described below in detail with reference to the drawings.

Figure 1A:
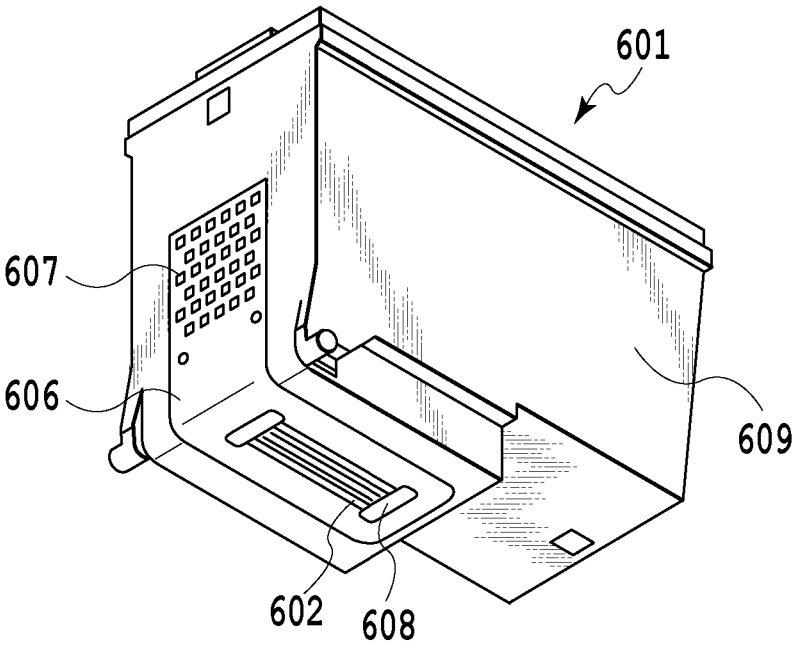
FIGS. 1A and 1B are perspective views showing an inkjet cartridge including a print head for ejecting an ink and an ink tank which are integrally formed according to an embodiment of the present invention.
Figure 1B:
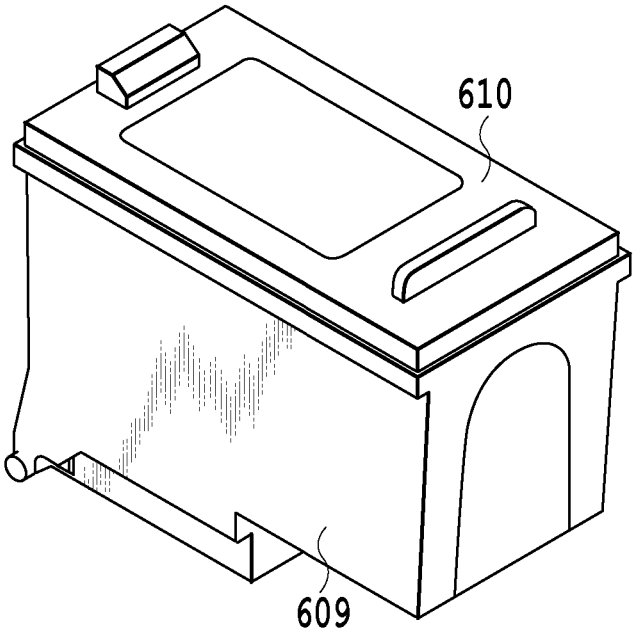

FIGS. 1A and 1B are perspective views showing an inkjet cartridge (a liquid ejection system) including a print head for ejecting an ink and an ink tank which are integrally formed according to an embodiment of the present invention. In FIGS. 1A and 1B, an inkjet cartridge 601 of the present embodiment mainly includes a chip-shaped print head 602 and a case 609 constituting an ink tank which are integrally formed.

The print head 602 as a liquid ejection head includes: a substrate having formed thereon a heater for generating thermal energy used for ejecting an ink; and a nozzle plate having formed therein ejection openings corresponding to the heater. An electric signal is transmitted from a main body of an inkjet printing apparatus to the print head 602 via an electric wiring tape 606 and an external signal input terminal 607. Two end surfaces of the print head 602 are electrically connected to the electric wiring tape 606, and these electric connection parts are covered with a sealing material 608.

An ink absorber (a liquid holding member) is contained in space defined by the case 609 and a lid 610 to form the ink tank as a liquid storage container.

An ink supply path for supplying an ink to the print head 602 is provided on the side of the print head in the case 609. Further, a filter (not shown) is provided at an end of the supply path. In this manner, the ink in the ink tank passes via the filter (ink communication/liquid communication). The filter suppresses the entry of foreign substances into an ink path and the ejection openings in the print head 602.

Next, explanation will be made on the principles of controlling ink pressure on the filter when injecting inks into the ink tank by using a plurality of injection needles to fill the ink tank with the inks.

Figure 2A:
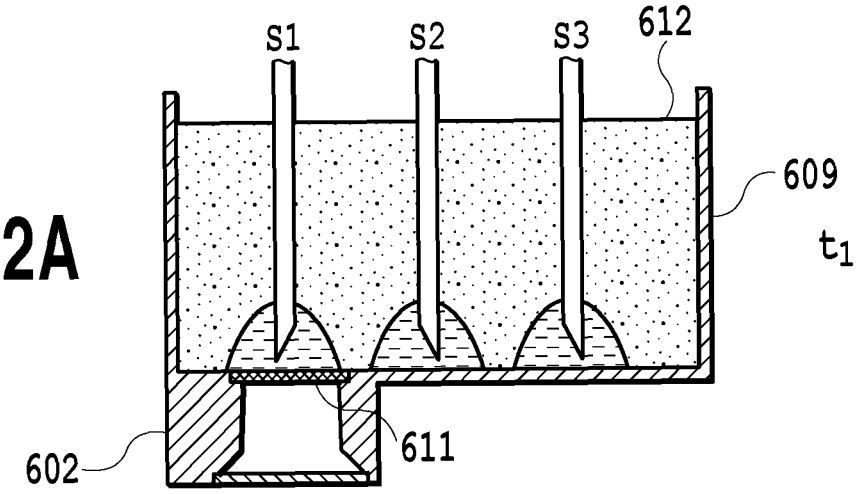
FIGS. 2A to 2C are views for explaining a method for injecting inks by using a plurality of injection needles.
Figure 2B:
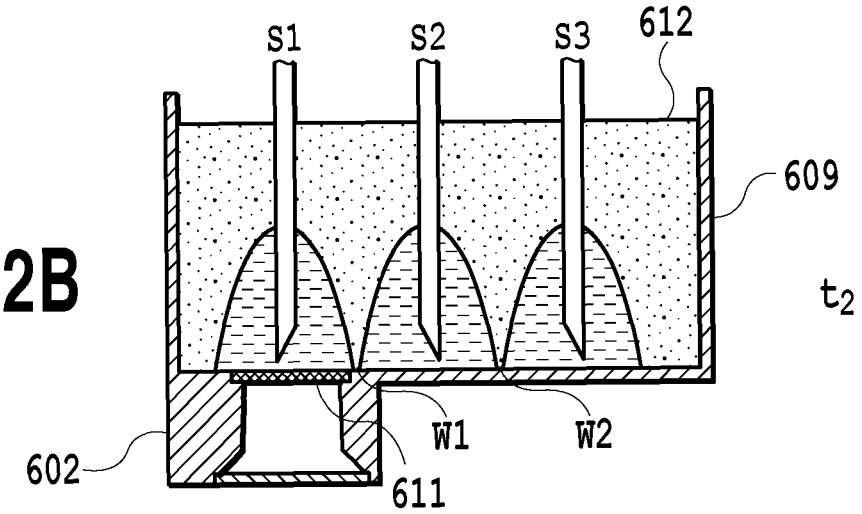
Figure 2C:
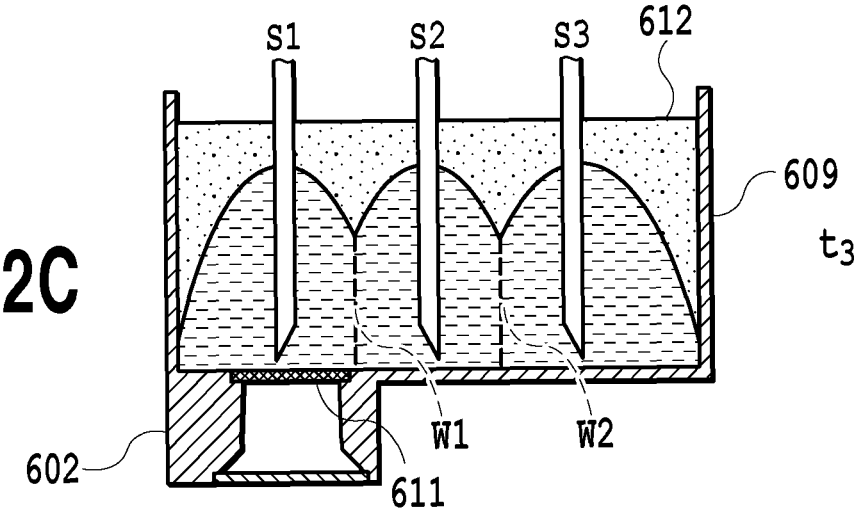

FIGS. 2A to 2C are views for explaining a method for injecting inks by using a plurality of injection needles, and show ink injections in time series. As shown in these figures, an absorber 612 as an ink holding member is stored in the tank case 609, and at the time of filling inks, three injection needles S1, S2, and S3 are inserted into the absorber 612 to inject the inks. Further, a filter 611 is provided in a supply path in connection parts for connection between the tank case 609 and the print head 602. The three injection needles S1, S2, and S3 are inserted at positions such that the three injection needles divide the absorber 612 into four substantially equal parts in a lateral direction in the figures. More specifically, the insertion position of each needle is determined according to the injection flow rate of the injection needle so that the inks permeate the whole absorber uniformly. Further, in the figures, reference signs t1, t2, and t3 representing injection times have a relationship t1<t2<t3.

In this example, ink injections from the injection needles S1, S2, and S3 are started simultaneously at the same injection speed (injection flow rate).

As shown in FIG. 2A, when the time t1 passes after the start of the injections, the ink is injected from each injection needle and permeates the absorber. Next, as shown in FIG. 2B, when the time t2 passes after the start of the injections, the ink is injected from each injection needle and uniformly permeates the absorber, and the inks from the injection needles S1 and S2 begin to meet at a point W1 and the inks from the injection needles S2 and S3 start to meet at a point W2. Then, as shown in FIG. 2C, when the time t3 passes after the start of the injections, the ink is injected from each injection needle and uniformly permeates the absorber, and ink meeting surfaces are formed at the points W1 and W2. In the present comparative example, in each meeting surface, the pressure of the ink from the injection needle S1 is substantially equal to the pressure of the ink from the injection needle S2, and the pressure of the ink from the injection needle S2 is substantially equal to the pressure of the ink from the injection needle S3, and accordingly, the positions of the meeting surfaces do not move. The ink meeting surfaces at the positions W1 and W2 are located substantially halfway between the injection needle S1 and the injection needle S2 and between the injection needle S2 and the injection needle S3, respectively. When such meeting surfaces are formed, the inks move and permeate in a direction of space with smaller flow resistance (voids and the like in the absorber). Ink permeation force depends on the injection pressures of the inks pushed from the injection needles and the capillary force of the absorber.

In this manner, in this example, ink pressure on the filter 611 is equal to pressure at another position with a geometrically identical condition with respect to the three injection needles.

In contrast, in the present invention, ink pressure on the filter 611 is made larger than pressure at another position with a geometrically identical condition with respect to the three injection needles.

FIGS. 3A to 3D are views for explaining a method for injecting inks by using the plurality of injection needles according to the present invention. In FIGS. 3A to 3D, the same reference signs are assigned to the same elements as the ones shown in FIGS. 2A to 2C, and explanation thereof is omitted. In the figures, times t1, t2, t3, and t4 representing injection times have a relationship t1<t2<t3<t4.

In this example, the timing of the injection from the injection needle S1 is made different from the timing of the injections from the injection needles S2 and S3. Further, the injection speeds (injection flow rates) of the three injection needles are the same.

Figure 3A:
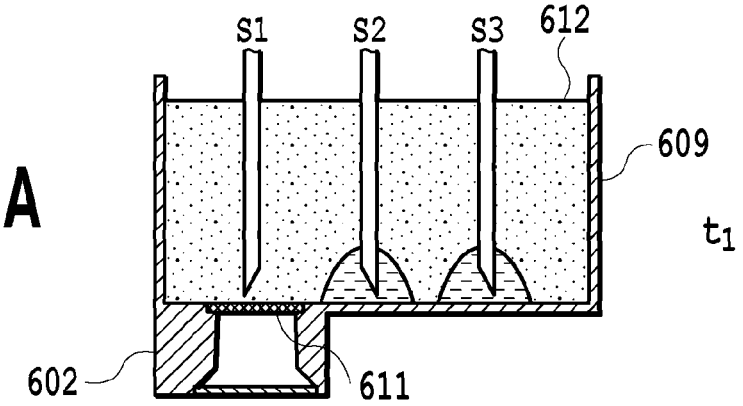
FIGS. 3A to 3D are views for explaining a method for injecting inks by using the plurality of injection needles.

As shown in FIG. 3A, when the time t1 passes after the start of the injections, the inks are injected only from the injection needles S2 and S3, and the ink is not injected from the injection needle S1. The inks injected from the injection needles S2 and S3 permeate the absorber.

Figure 3B:
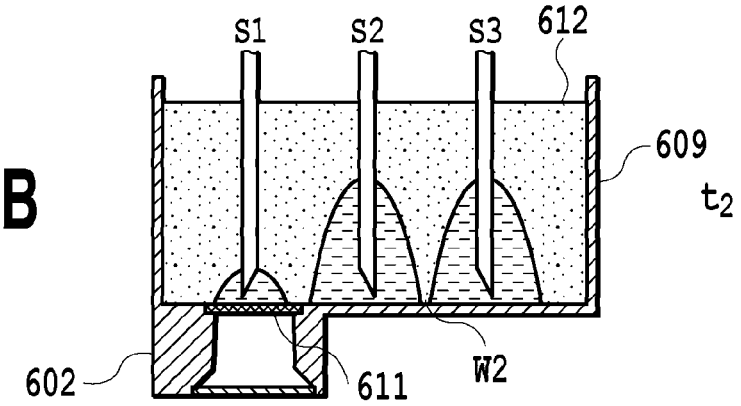

Next, as shown in FIG. 3B, when the time t2 passes after the start of the injections, the inks continue to be injected from the injection needles S2 and S3, and continue to permeate the absorber. The permeating inks injected from the injection needles S2 and S3 meet in the point W2. Moreover, when the time t2 passes after the start of the injections, the ink injection from the injection needle S1 is started.

Figure 3C:
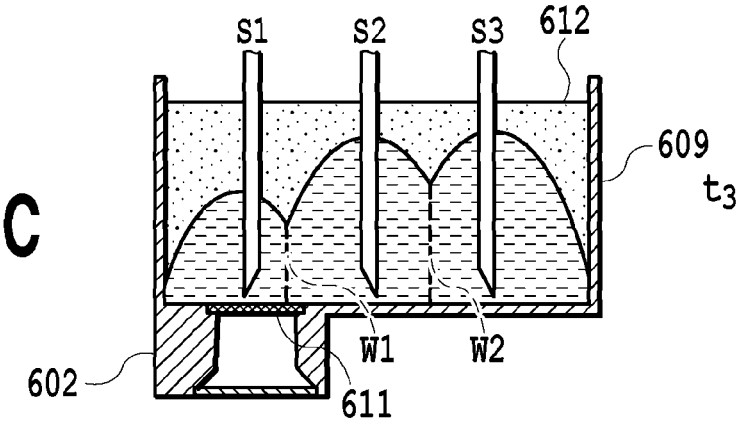

Further, as shown in FIG. 3C, when the time t3 passes after the start of the injections, the inks from the injection needles S1 and S2 permeate and form a meeting surface at the position W1. Further, the inks from the injection needles S2 and S3 permeate and form a meeting surface at the position W2. The position W1 of the meeting surface between the injection needle S1 and the injection needle S2 is located closer to the injection needle S1 than the position W1 shown in FIG. 2. The position of the meeting surface can be made closer to the injection needle S1 by starting the injection from the injection needle S1 later than the injections from the other injection needles.

Figure 3D:
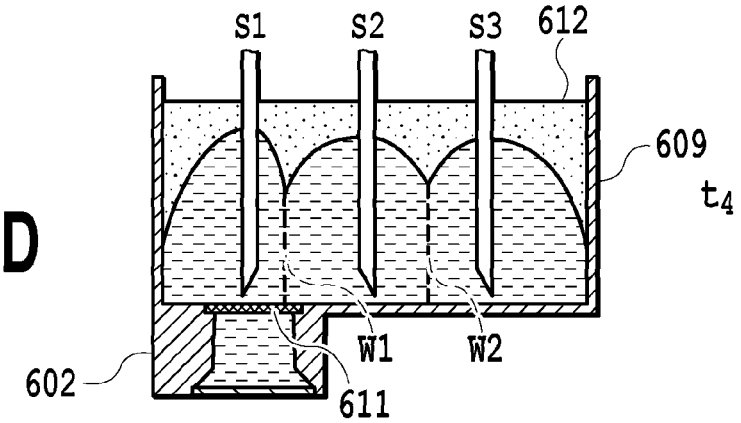

FIG. 3D shows an ink injection state at the time when the time t4 passes after the start of the injections, and as described above, the ink meeting surface W1 between the injection needle S1 and the injection needle S2 is closer to the injection needle S1. More specifically, the meeting surface between the liquid injected from the injection needle S1 above the filter and the liquid injected from the injection needle S2 adjacent to the injection needle S1 above the filter is located closer to the injection needle S1 above the filter than the injection needle S2 adjacent to the injection needle S1 above the filter. In FIG. 3D, in particular, the meeting surface W1 is located above the filter 611. Further, since ink movement at the meeting surface W1 is limited, larger pressure is applied to the filter (in a downward direction in the figures) and voids in the absorber (in an upward direction in the figures) as compared with the state in which the inks are injected at the same timing as shown in FIGS. 2A to 2C, and the inks permeate. It should be noted that the total momentum of the inks of the comparative example shown in FIG. 2 is equal to that of the embodiment shown in FIG. 3.

As described above, the meeting surface between the inks injected from the injection needles can be made closer to the injection needle S1 (the filter) by varying the timings of the ink injections from the injection needles, whereby larger pressure is applied to the filter. When pressure is applied which is larger than the ink holding force (liquid holding force) of the filter generated from the surface tension of the inks, as shown in FIG. 3D, the inks pass through the filter to fill space from the ink supply path to the ink path in the print head. In this manner, the ink pressure on the filter can be appropriately controlled without increasing the amount of the ink from the injection needle above the filter. As a result, the inks pass through the filter to fill the ink path in the print head, and the inks can be prevented from leaking from the ejection openings at the time of filling the inks.

Next, explanation will be made on embodiments to which the above-described principles of the liquid injection method of the present invention are applied.

FIRST EMBODIMENT

Figure 4:
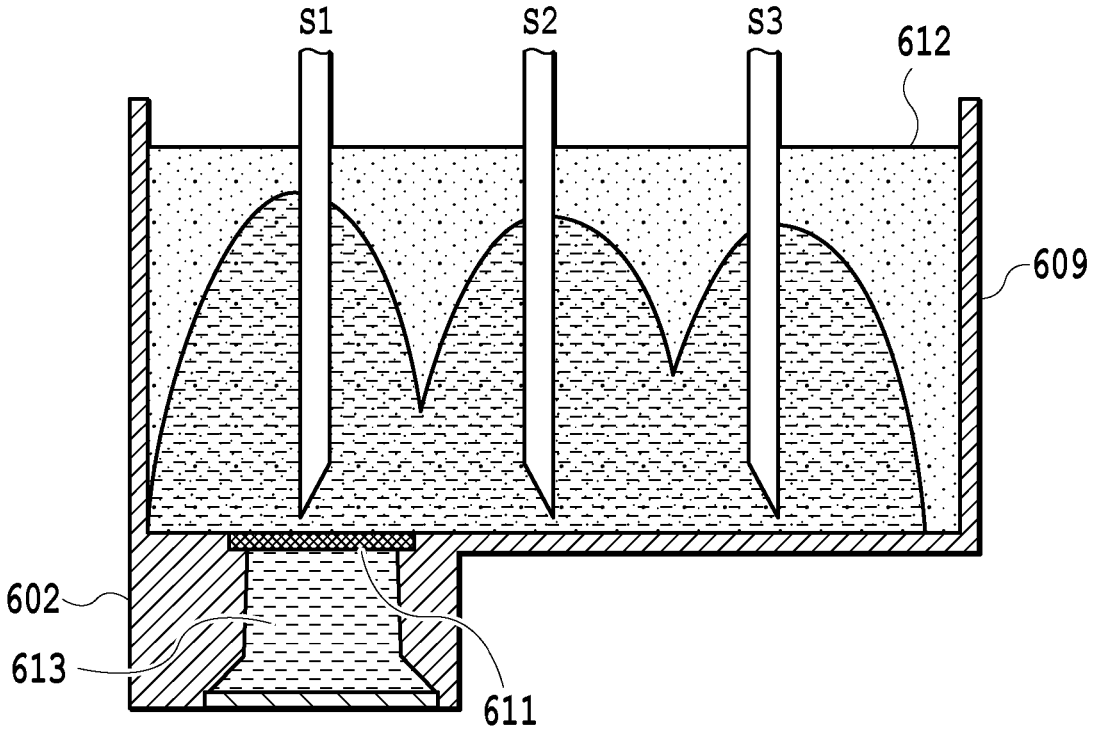
FIG. 4 is a schematic view showing a state in which inks are injected into an inkjet cartridge of a first embodiment of the present invention by using injection needles.

FIG. 4 is a schematic view showing a state in which inks are injected into an inkjet cartridge of a first embodiment of the present invention by using injection needles. As described above with reference to FIG. 1, in the inkjet cartridge of the present embodiment, the ink absorber 612 is stored in the tank case 609. The tank case 609 and the chip-shaped print head 602 are integrally formed. The filter 611 is provided on the tank-case side of an ink supply path 613 in the print head 602. The ink absorber 612 holding the ink is in pressure contact with the filter 611 with an appropriate amount, and this makes it possible to supply the ink held in the ink absorber 612 to the print head 602 in response to an ink ejection by the print head 602.

The injection needles S1, S2, and S3 are used to inject the inks into the ink absorber 612. These injection needles are connected to an ink injector (not shown), whereby the inks are supplied to the injection needles. These injection needles are inserted into the ink absorber 612, and the inks are pushed and injected from the tip ends of the ink injection needles by pressurizing the ink in the ink injector.

Figure 5A:
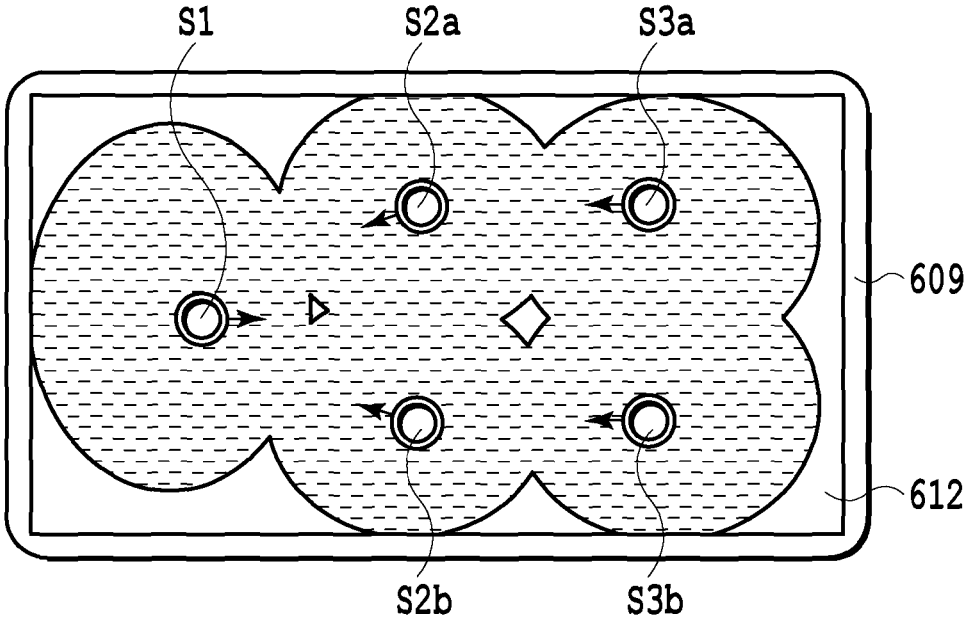
FIGS. 5A and 5B are views showing a detailed structure for filling an ink according to the first embodiment shown in FIG. 4.
Figure 5B:
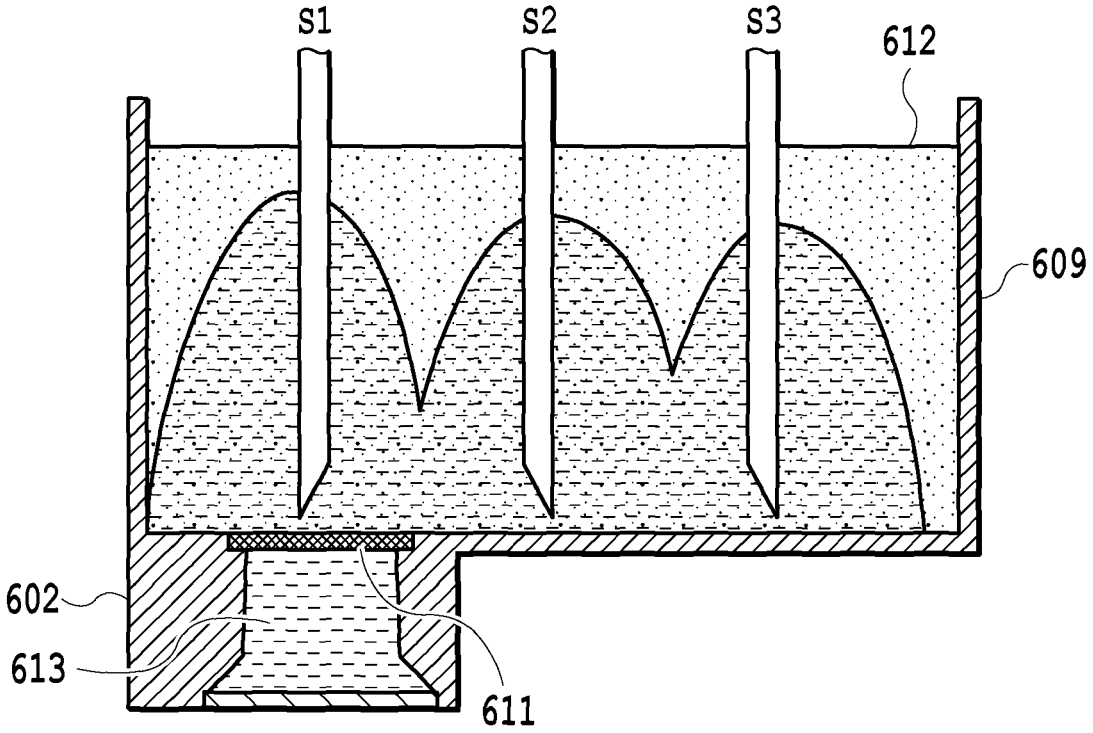

FIGS. 5A and 5B are views showing a detailed structure for filling an ink according to the first embodiment shown in FIG. 4.

In the present embodiment, as shown in FIG. 5A, five ink injection needles are used to inject the inks. The injection needle S1 is made up of one injection needle, and this injection needle is connected to one ink injector. Further, the injection needle S2 is made up of two injection needles S2*a* and S2*b*, and these injection needles are connected to one ink injector, whereby the ink from the ink injector is branched and supplied to the injection needles S2*a* and S2*b*. Likewise, the injection needle S3 is made up of two injection needles S3*a* and S3*b*, and these injection needles are connected to one ink injector, whereby the ink from the ink injector is branched and supplied to the injection needles S3*a* and S3*b*. As shown in FIG. 5B, the injection needles S1, S2 (S2*a* and S2*b*), and S3 (S3*a* and S3*b*) are arranged at substantially equal intervals, and the injection needle S1 is located above the filter 611.

Figure 6A:
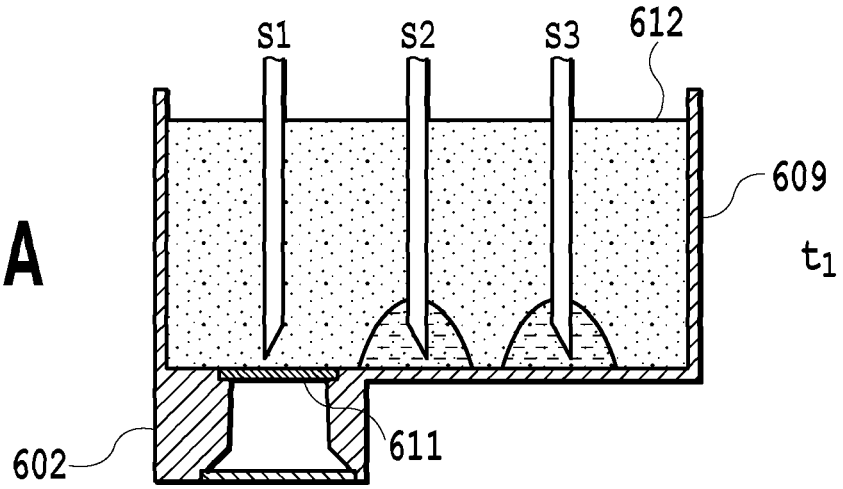
FIGS. 6A to 6C are views for explaining a method for injecting inks by using three injection needles according to the first embodiment.
Figure 6B:
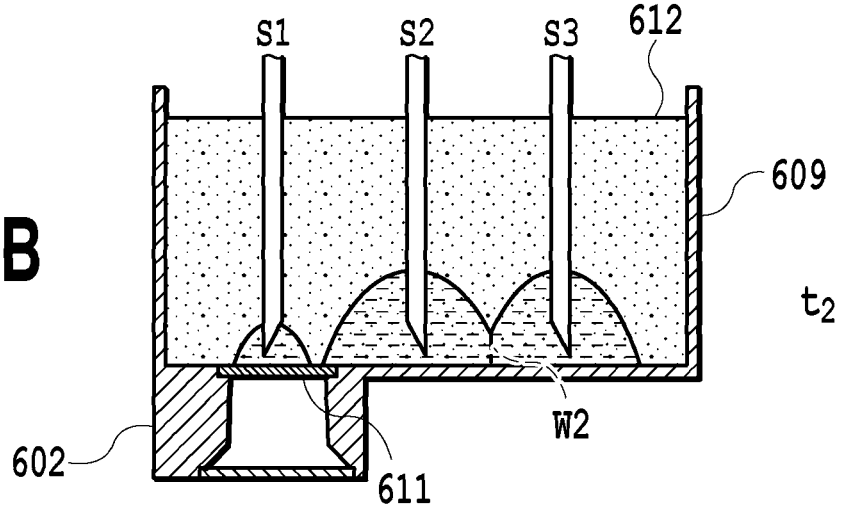
Figure 6C:
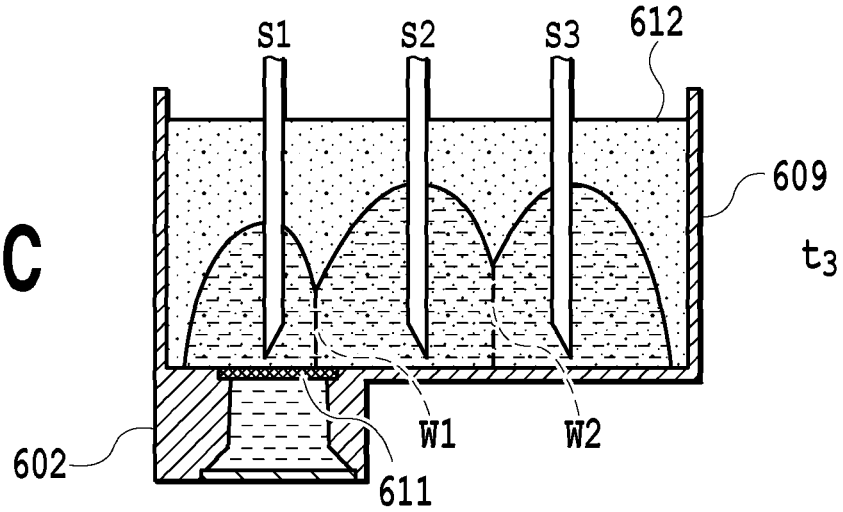

FIGS. 6A to 6C are views for explaining a method for injecting inks by using the five injection needles according to the present embodiment.

As shown in FIG. 6A, when the time t1 passes after the start of the injections, the inks are injected from the injection needles S2 (S2*a*+S2*b*) and S3 (S3*a*+S3*b*) at an injection speed (injection flow rate) of 2.7 g/sec to permeate the absorber. More specifically, the ink is injected from each set of the two injection needles (S2*a*+S2*b*) and (S3*a*+S3*b*) at the injection speed of 2.7 g/sec, and the injection speeds of the two injection needles in each set (S2*a* and S2*b*) and (S3*a* and S3*b*) are substantially the same. The following explanation will be made by regarding the injections from the sets of two injection needles collectively as the injections from the injection needles S2 and S3 respectively.

Next, as shown in FIG. 6B, when the time t2 (=0.5 seconds) passes after the start of the injections, the inks continue to be injected from the injection needles S2 and S3 and start to permeate the absorber, and the inks from the injection needles S2 and S3 meet in the position W2. At the same time, an ink injection from the injection needle S1 is started at an injection speed of 2.7 g/sec.

Further, as shown in FIG. 6C, when the time t3 passes at the start of the injections, the inks injected from the injection needles S1 and S2 form a meeting surface at the position W1. This position W1 is located closer to the injection needle S1 than the injection needle S2 and above the filter 611.

In the above injection process, when the time t of 0.75 second passes after the start of the injections, the injection from the injection needle S3 is stopped. Further, when the time t of 1.80 seconds passes after the start of the injections, the injection from the injection needle S1 is stopped. Lastly, when the time t of 1.85 seconds pass after the start of the injections, the injection from the injection needle S2 is stopped. In this injection process, 3.5 g of the ink is injected from the injection needle S1, 5.0 g of the ink is injected from the injection needle S2 (S2*a*+S2*b*), 2.0 g of the ink is injected from the injection needle S3 (S3*a*+S3*b*), and a total of 10.5 g of the ink fills the inkjet cartridge. A cycle time for the ink injection process is 1.85 seconds.

As described above, in the first embodiment of the present invention, the lateral movement of the ink is limited at the position W1 where the meeting surface is formed, and therefore, the ink pressure is applied in a direction of the filter (the downward direction in the figures) or in a direction of the voids in the absorber (mainly the upward direction in the figures) to cause the ink to move and permeate. More specifically, the ink pressure applied to the filter causes the ink on the side of the filter to pass through the filter 611 to fill space from the ink supply path to the ink path in the print head 602. In this manner, the meeting surface between the inks injected from the injection needles is positioned closer to the filter, whereby the ink pressure toward the filter can be increased. This makes it possible to fully fill, with the inks, space from the ink supply path to the ink path in the print head without increasing the amount of the ink from the injection needle above the filter. In particular, it is preferable that the meeting surface W1 be above the filter because the ink can be fully filled.

SECOND EMBODIMENT

Figure 7A:
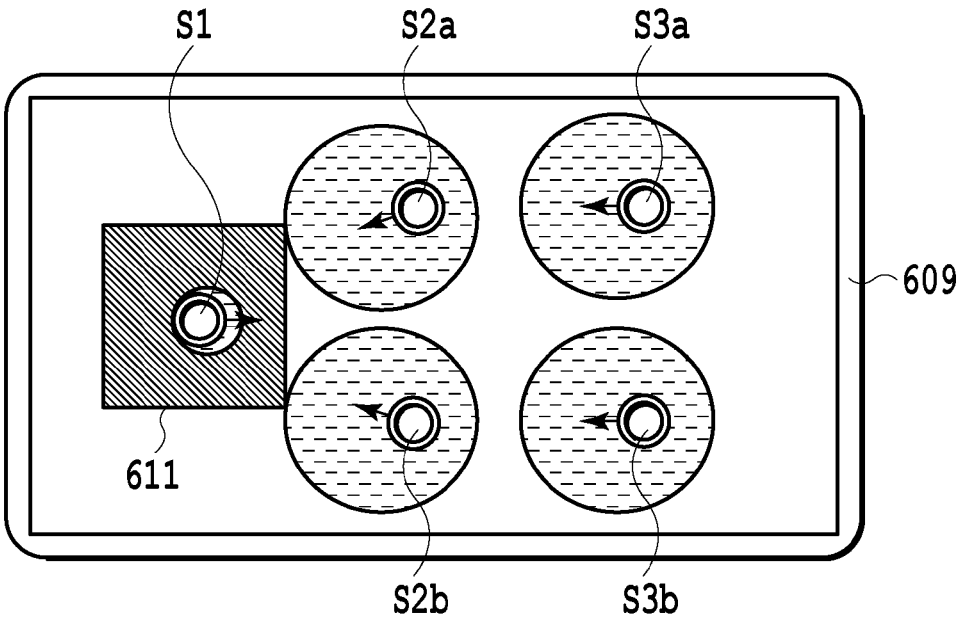
FIGS. 7A and 7B are schematic views showing a state in which inks are injected into an inkjet cartridge of a second embodiment of the present invention by using injection needles.
Figure 7B:
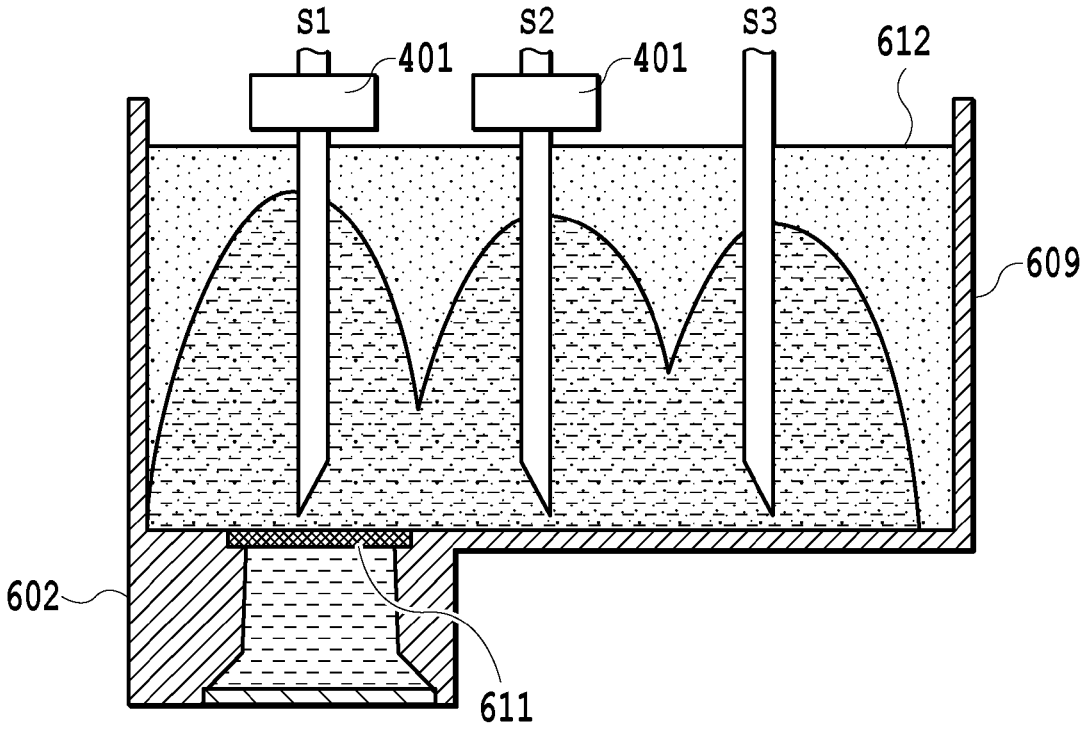

FIGS. 7A and 7B are schematic views showing a state in which inks are injected into an inkjet cartridge of a second embodiment of the present invention by using injection needles. As shown in FIGS. 7A and 7B, features for injecting inks according to the present embodiment include: a detector (not shown) for detecting electrical conduction between electrodes 401 connected to the injection needles S1 and S2; and a controller (not shown) for controlling an ink injection operation in response to the detection. The ink injection needles and the filter are formed by using a conducting material such as SUS.

In the ink injection process, first, the inks are injected from the injection needle S2 (S2*a*+S2*b*) and the injection needle S3 (S3*a*+S3*b*) at the injection speed of 2.7 g/sec to permeate the absorber. Further, a small amount of the ink is injected from the injection needle S1 so that the ink injected from the tip end of the injection needle S1 is in contact with the filter to form the electrical conduction between the filter and the injection needles S1.

After that, when the ink injected from the injection needle S2 and permeating the absorber is in contact with the filter, the conduction is established between the electrode connected to the injection needle S1 and the electrode connected to the injection needle S2, and this conduction is detected by the detector. At the timing of detecting the conduction, the ink injection from the injection needle S1 is started at the injection speed of 2.7 g/sec. This injection forms the meeting surface (W1) between the inks from the injection needles S1 and S2, and its position W1 is located closer to the injection needle S1 than the injection needle S2 and above the filter.

In the present embodiment, when it is detected that the ink injected from the injection needle S2 adjacent to the injection needle S1 above the filter 611 is in contact with the filter 611, the ink injection from the injection needle S1 above the filter 611 is started. This makes it easy to control the position of the meeting surface W1 between the inks from the injection needles S1 and S2. Accordingly, it becomes possible to fully fill, with the inks, space from the ink supply path to the ink path in the print head.

OTHER EMBODIMENTS

It should be noted that the above-described meeting surface W1 can also be located closer to the injection needle above the filter by setting the injection speed of the liquid injection from the injection needle above the filter to be different from the injection speed of the liquid injection from the injection needle adjacent to the injection needle above the filter. In the step of injecting liquids into the liquid holding member from the plurality of injection needles, the liquids are injected from the injection needles so that the injection speed of the liquid from the injection needle above the filter is lower than the injection speed of the liquid from the injection needle which is at least adjacent to the injection needle above the filter. This locates the meeting surface closer to the injection needle above the filter than the injection needle adjacent to the injection needle above the filter.

Further, the plurality of injection needles may be inserted so that a distance between the injection needle above the filter and the injection needle adjacent to the injection needle above the filter is the smallest among distances between two of the plurality of injection needles. This can position the meeting surface closer to the injection needle above the filter than the injection needle adjacent to the injection needle above the filter. It should be noted that the injection needle adjacent to the injection needle above the filter may be located above the filter or may be not located above the filter.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-006788 filed Jan. 17, 2014, and No. 2014-217485 filed Oct. 24, 2014, which are hereby incorporated by reference wherein in their entirety.

What is claimed is:

1. A method for injecting a liquid into a liquid holding member in a liquid storage container, in a liquid ejection system having the liquid storage container containing therein the liquid holding member for holding a liquid and a liquid ejection head which is in liquid communication with the liquid storage container via a filter, said method comprising:

a step of inserting a plurality of injection needles into the liquid holding member, at least one of the injection needles being inserted above the filter; and a step of injecting liquids from the plurality of injection needles into the liquid holding member;

wherein in the step of injecting the liquids from the plurality of injection needles into the liquid holding member, the liquids are injected from the injection needles so that the liquid injection from the injection needle above the filter is started later than the liquid injection from an injection needle which is at least adjacent to the injection needle above the filter is started.

2. The method according to claim 1, wherein the meeting surface between the liquid injected from the injection needle above the filter and the liquid injected from the injection needle adjacent to the injection needle above the filter is located above the filter.

3. The method according to claim 1, wherein a meeting surface between the liquid injected from the injection needle above the filter and the liquid injected from the injection needle adjacent to the injection needle above the filter is located closer to the injection needle above the filter than the injection needle adjacent to the injection needle above the filter.

4. The method according to claim 1, wherein in the step of injecting the liquids from the plurality of injection needles into the liquid holding member, the liquids are injected from the injection needles so that an injection speed of the liquid injected from the injection needle above the filter is lower than an injection speed of the liquid from the injection needle which is at least adjacent to the injection needle above the filter.

5. The method according to claim 1, wherein the plurality of injection needles are inserted so that a distance between the injection needle above the filter and the injection needle adjacent to the injection needle above the filter is the smallest among distances between two of the plurality of injection needles.

6. The method according to claim 1, wherein injection pressure of the liquid from the injection needle above the filter is larger than liquid holding force of the filter.

7. A method for injecting a liquid into a liquid holding member in a liquid storage container, in a liquid ejection system having the liquid storage container containing therein the liquid holding member for holding a liquid and a liquid ejection head which is in liquid communication with the liquid storage container via a filter, said method comprising:

a step of inserting a plurality of injection needles into the liquid holding member, at least one of the injection needles being inserted above the filter; and a step of injecting liquids from the plurality of injection needles into the liquid holding member so that when the step of injecting the liquids is terminated, an amount of a liquid injected from the injection needle above the filter is smaller than an amount of a liquid injected from an injection needle adjacent to the injection needle above the filter.

8. The method according to claim 7, wherein a meeting surface between a liquid injected from the injection needle above the filter and a liquid injected from an injection needle adjacent to the injection needle above the filter is located closer to the injection needle above the filter than the injection needle adjacent to the injection needle above the filter.

9. The method according to claim 7, wherein in the step of injecting the liquids from the plurality of injection needles into the liquid holding member, the liquids are injected from the injection needles so that an injection speed of the liquid injected from the injection needle above the filter is lower than an injection speed of the liquid from the injection needle which is at least adjacent to the injection needle above the filter.

10. The method according to claim 7, wherein the meeting surface between the liquid injected from the injection needle above the filter and the liquid injected from the injection needle adjacent to the injection needle above the filter is located above the filter.

11. The method according to claim 7, wherein in the step of injecting the liquids from the plurality of injection needles into the liquid holding member, the liquids are injected from the injection needles so that the liquid injection from the injection needle above the filter is started later than the liquid injection from the injection needle which is at least adjacent to the injection needle above the filter is started.

12. The method according to claim 7, wherein the plurality of injection needles are inserted so that a distance between the injection needle above the filter and the injection needle adjacent to the injection needle above the filter is the smallest among distances between two of the plurality of injection needles.

13. The method according to claim 7, wherein injection pressure of the liquid from the injection needle above the filter is larger than liquid holding force of the filter.

* * * * *